United States Patent [19]

Takeda et al.

[11] Patent Number: 5,062,723

[45] Date of Patent: Nov. 5, 1991

[54] PRINTING APPARATUS

[75] Inventors: Fumio Takeda, Ushiku; Takashi Yoshida, Ibaraki; Hiroya Taguchi, Tokyo; Tsutomu Omine, Mito; Mitsugu Asano, Ibaraki, all of Japan

[73] Assignees: Hitachi, Ltd.; Hitachi Koki Co., Ltd., both of Tokyo, Japan

[21] Appl. No.: 353,695

[22] Filed: May 17, 1989

[30] Foreign Application Priority Data

May 18, 1988 [JP] Japan ..... 63-119123

[51] Int. Cl.[5] ..... B41J 3/02

[52] U.S. Cl. ..... 400/120; 400/635; 400/643

[58] Field of Search ..... 400/120, 635, 611, 617, 400/619, 643

[56] References Cited

U.S. PATENT DOCUMENTS 4,092,921 6/1978 McInnis et al. ..... 400/635

FOREIGN PATENT DOCUMENTS 0118885 9/1980 Japan ..... 400/635

*Primary Examiner*—Eugene H. Eickholt

*Attorney, Agent, or Firm*—Antonelli, Terry, Stout & Kraus

[57] ABSTRACT

A printing apparatus for effecting printing on a printing medium, comprising a rotatably supported platen roller, a printing head which faces the platen roller and which is designed to allow a printing medium to pass between it and the platen roller, rotary support members arranged on either side in the axial direction of the platen roller and the printing head, a mechanism for rotating the rotary support members, and printing medium retaining devices for continuously retaining the printing medium on the respective outer peripheries of the rotary support members in such a manner that it is movable with respect to the peripheries.

24 Claims, 8 Drawing Sheets

PRINTING APPARATUS

BACKGROUND OF THE INVENTION

1. Field of the Invention

This invention relates to a printing apparatus and, in particular, to a printing apparatus in which the printing medium is firmly retained on the drum to enable high-accuracy feed without involving any positional deviation, and which is suitable for use as a thermal-transfer printing apparatus.

2. Description of the Prior Art

A feed mechanism in a conventional thermal-transfer printing apparatus is disclosed in Japanese Utility Model Laid-Open No. 62-48547, wherein a printing medium fastening gripper, provided on the outer periphery of a platen drum having a circumference greater than the length of the printing medium used, fastens the tip of the printing medium to the drum. The mechanism design is such that, each time this gripper passes the thermal printing head, the printing head is retracted so as to avoid colliding with the gripper. According to another conventional printing apparatus disclosed in Japanese Patent Laid-Open No. 62-94363, a clamping mechanism is provided within the platen drum, thereby securing the printing medium in position.

In still another conventional printing apparatus disclosed in Japanese Patent Laid-Open No. 61-137458, the edge of a printing medium is fastened by grippers at three positions on a gripper chain which guides them along a circular locus, thereby effecting rotational guidance of the printing medium between the platen roller and the printing head.

In the above-mentioned printing medium fastening mechanism using a gripper (Japanese Utility Model Laid-Open No. 62-48547), the thermal printing head must be retracted each time the gripper section passes to avoid colliding with the thermal printing head. The clamp mechanism disclosed in Japanese Patent Laid-Open No. 62-94363 involves a high drum cost and a complicated structure since the mechanism is lodged within the drum. Moreover, both conventional systems are so designed that the printing medium is only fastened at its tip, so that deviation of the printing medium during printing cannot be avoided completely, this being a hindrance to realizing a highly accurate feed function.

In the system for fastening the printing medium edge disclosed in Japanese Patent Laid-Open No. 61-137458, grippers can only be provided at several positions. That is, it only provides partial fastening and this does not retain the printing medium in a satisfactory manner, so that highly accurate feeding cannot be effected. Also, since the platen roller has to be shifted each time these grippers pass its position, a complicated mechanism is inevitable.

SUMMARY OF THE INVENTION

It is accordingly an object of this invention to provide a printing apparatus which can realize highly accurate feeding by fastening a printing medium to rotary support members in a reliable manner and which can avoid any collision between a printing head and a means for fastening the printing medium to the rotary support members without the need to retract the printing head during the rotation of the rotary support members.

The above object can be attained with a printing apparatus comprising a rotatably supported platen roller, a printing head which faces the platen roller and which is designed to allow a printing medium to pass between it and the platen roller, rotary support members arranged on either side in the axial direction of the platen roller and the printing head, a mechanism for rotating the rotary support members, and a printing medium fastening member adapted to fasten the printing medium to the outer peripheries of the rotary support member continuously and in such a manner that it is movable with respect to the outer peripheries.

In the printing apparatus thus constructed, the respective end sections of the printing medium are fastened to the respective peripheries of a pair of rotary support members, with printing being effected by the action of the printing head as the printing medium passes between the platen roller and the printing head when the rotary support members rotate. By virtue of the arrangement described above, the printing head does not collide with the printing medium fastening means.

A particular feature of the above printing apparatus is that the diameter of the platen roller may be smaller than that of the rotary support members, and the pressurizing load applied to the printing head for the purpose of obtaining the requisite surface pressure for the nipping section between the printing head and the platen roller can be relatively small, thus giving the head a longer service life.

Furthermore, since high rigidity drums form the rotary support members and the printing medium is fastened to the outer peripheries of the rotary support members over its entire length, the printing medium so fastened can be fed reliably and with high precision without involving any positional deviation. In addition, since the printing medium fastening means are provided on both of the outer sides with respect to the printing head, the rotation of the rotary support members does not involve any collision between the fastening means and the printing head, so that it is not necessary for the head to retract to avoid collision as in the prior art. If the platen roller is provided as a separate member with respect to the drums on either side thereof and its diameter is smaller than that of the latter, the load which has to be applied to the thermal printing head to obtain the requisite surface pressure can be relatively small, so that the printing head can be expected to enjoy a longer service life.

The printing apparatus thus constructed is suitable for use as a thermal-transfer printing apparatus of the type in which thermal transfer is effected by passing a printing medium and an ink film between a platen roller and a thermal printing head.

DETAILED DESCRIPTION OF THE PREFERRED EMBODIMENTS

Figure 1:
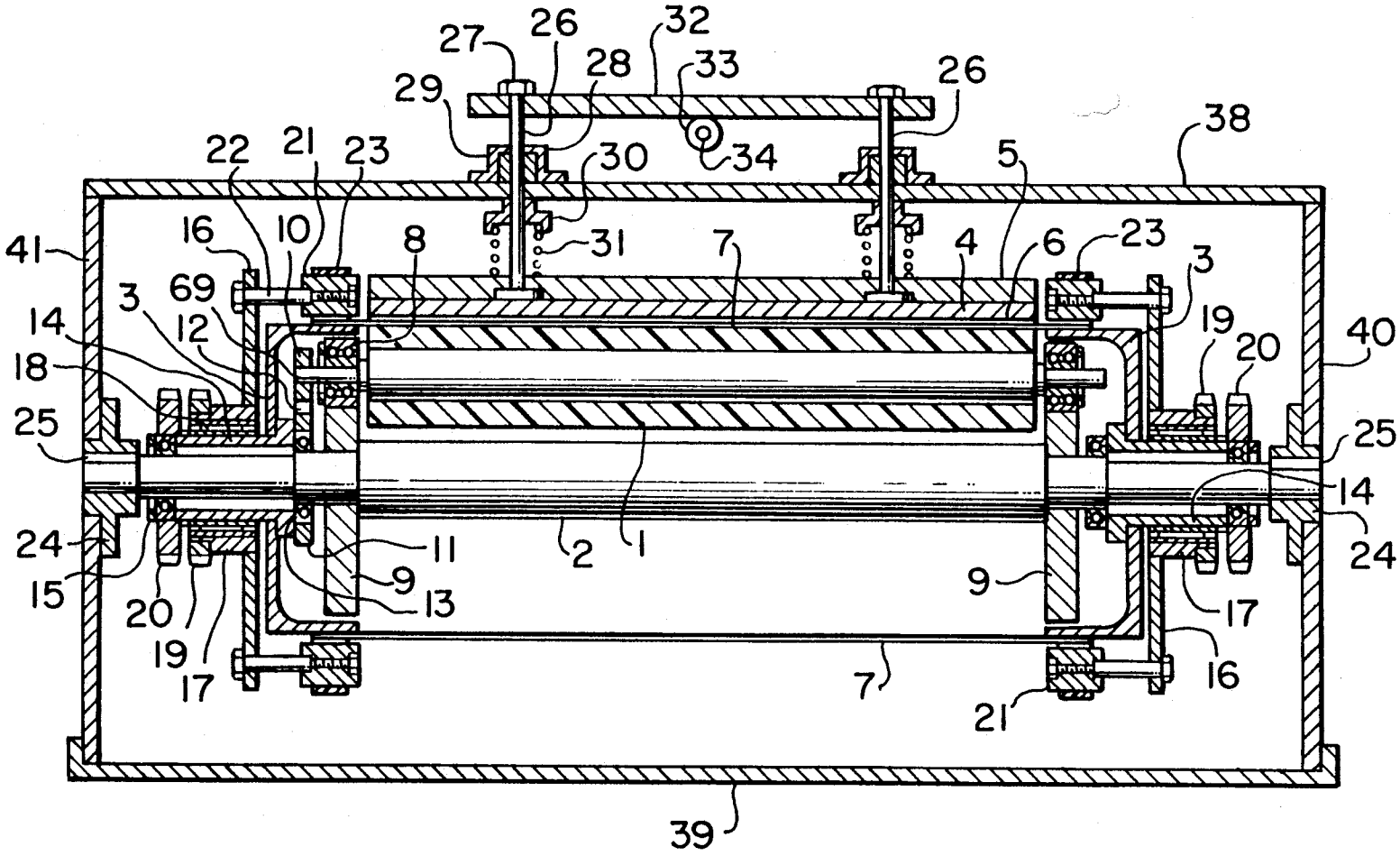
FIG. 1 is a longitudinal sectional view of a first embodiment of this invention.
Figure 2:
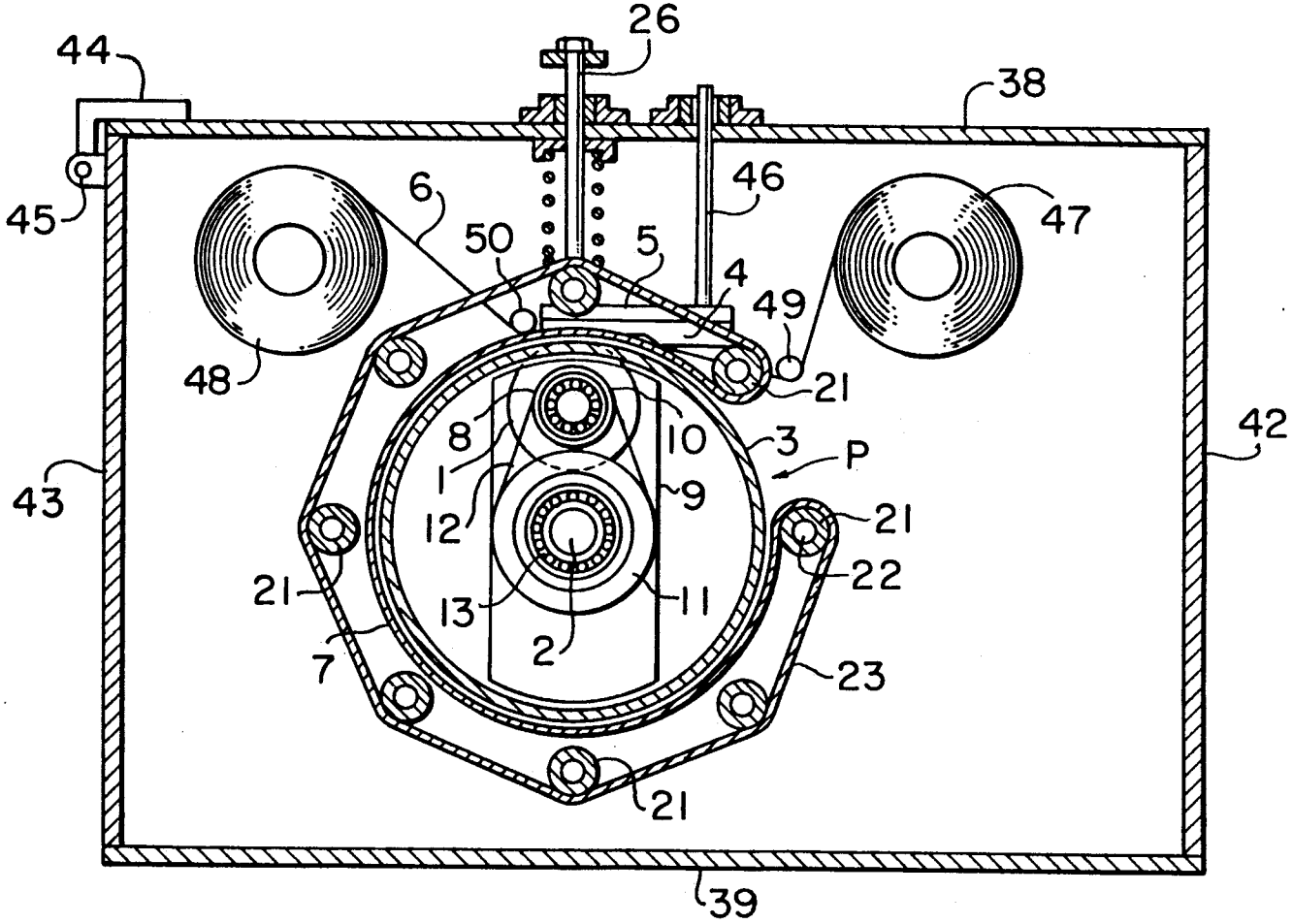
FIG. 2 is a cross-sectional view of the first embodiment.
Figure 3:
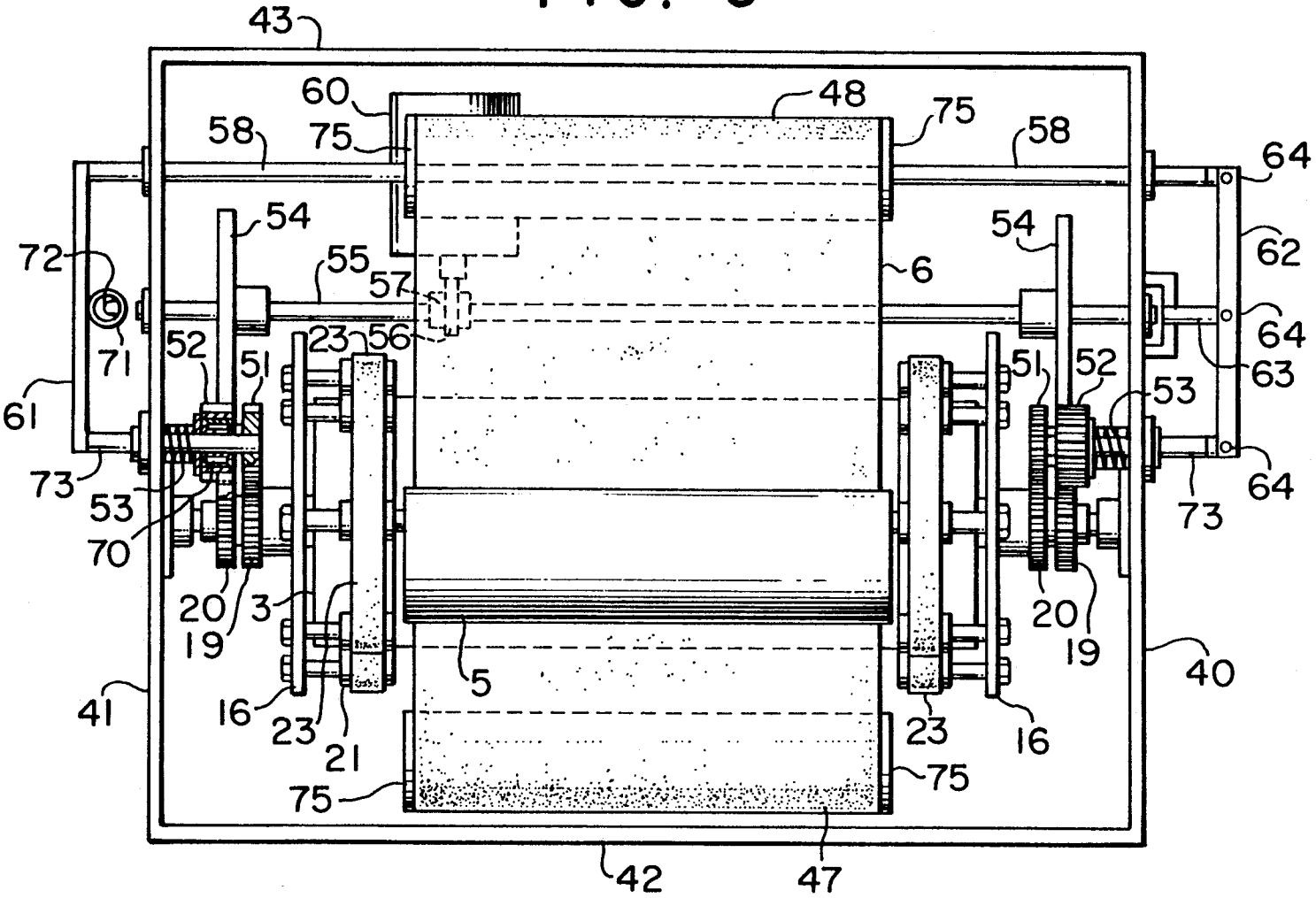
FIG. 3 is a plan view of the first embodiment.

Referring now to the drawings wherein like reference numerals are used throughout the various views to designate like parts and, more particularly, to FIGS. 1–4, according to these Figures, a first embodiment of a printing apparatus according to the present invention includes a box-like frame defined by a top board 38, a bottom board 39, side boards 40 and 41, and a front and a back board 42 and 43. The structure in the frame, as shown in FIGS. 1 and 3, has a substantially symmetrical configuration. In the following, the structure of the embodiment will be described by principally focusing on the part shown on the left-hand side.

As shown in FIG. 1, a platen roller 1 has an axle 69 which is supported by a bearing 8 provided in a thick plate 9 fixed to a stationary shaft 2. The end sections of the stationary shaft 2 are respectively fitted into flanges 24 and fixed to prevent rotation by keys 25. The flanges 24 are respectively secured to the right and left side boards 40 and 41, thereby fixing the stationary shaft 2. Cylindrical axles 14 are rotatably arranged on the respective end sections of the stationary shaft 2 through the intermediary of bearings 13 and 15. Fixed to the respective cylindrical axles 14 are drums 3 which constitute the rotary support members and which are provided as separate members with respect to the platen roller 1. A driving pulley 11 is fixed to one of the cylindrical axes (the one on the left-hand side). Provided at one end of the axle 69 of the platen roller 1 is a driven pulley 10 to which torque is transmitted from the driving pulley 11 through a belt 12. While in the example shown the driven pulley 10, the driving pulley 11 and the belt 12 are only provided on the left-hand side, they may also be provided on the right-hand side. Further, cylindrical axles 17 are rotatably arranged on the respective cylindrical axles 14 through the intermediary of bearings 18.

Next, the means for fastening the printing medium will be described. Each cylindrical axle 17 is fitted into and secured to a flange 16 to which pulley axles 22 rotatably supporting pulleys 21 are fixed. An elastic belt 23 is wound around the freely rotatable pulleys 21. The pulley axles 22 are so disposed on the flange 16 that a plurality of pulleys 21 are arranged with substantially the same pitch around the outer periphery of the drum 3.

The loop-like elastic belt 23 is suspended between the pulleys 21 and the drum 3. As shown in FIG. 2, the elastic belt 23 is so suspended that its outer peripheral surface is in contact with the outer peripheral surface of the drum 3 and that its inner peripheral surface is in contact with the pulleys 21. In a section P belt 23 exists between the loop ends of the belt 23. Gears 20 and 19 having the same number of teeth are respectively fitted over and secured to the cylindrical axles 14 to which the drums 3 are fixed and the cylindrical axles 17 to which the flanges 16 are fixed, thus forming a mechanism for rotating the drums 3. The top board 38 supports a thermal printing head 4 which faces the platen roller 1, with printing and feeding being effected while allowing a printing medium 7 and an ink film 6 laid one over the other to pass between the thermal printing head 4 and the platen roller 1. That part of the peripheral surface of the platen roller which is at the position where it faces the thermal printing head 4 is at the same level as the peripheral surfaces of the drums 3. The drums 3 have a circumference which is sufficient to allow the entire length of the printing medium to be wound around them. Next, the mechanism for retracting the thermal printing head 4 will be described. The thermal printing head 4 is fixed to a base plate 5 to which a plurality of slide shafts 26 and 46 are fixed. The number of the slide shafts 26 and 46 may, for example, be three or four, as shown in FIGS. 1 and 2. The slide shafts 26 and 46 are supported in such a manner as to be slidable only in the vertical direction by needle-like roller bearings 29 in flanges fixed to the top board 38. Coil springs 31 are provided between spring seats 30 fixed to the top board 38 and the base plate 5, thereby generating in the head 4 a pressurizing force that acts in the direction of the platen roller 1. The upper ends of the slide shafts 26 are fixed to single plate member 32 whose lower surface is in contact with a disc 33 that is eccentrically fixed to an axle 34. The axle 34 is supported by a bearing (not shown) that is supported by the top board 38. Accordingly, by rotating the axle 34 by a motor (not shown) through a worm and a worm wheel (not shown), the plate member 32, and consequently, the thermal printing head 4 can be retracted from the platen roller 1.

As shown in FIG. 2, the ink film 6 is supplied from a supply roll 47 which is rotatably supported and which has a certain degree of braking resistance. After printing, the ink film 6 is rolled onto a take-up roll 48 which is also rotatably supported and which generates a certain degree of take-up torque. In the drawings, the ink-film roll supporting mechanism is omitted. The embodiment shown further includes a peeling roller 50 and a guide roller 49. The top board 38, which holds the thermal printing head 4 and the retracting mechanism mentioned above, can be opened and closed around a pin 45 in a hinge 44.

As shown in FIG. 3, the gears 20 fitted over and secured to the cylindrical axles 14 as well as the gears 19 fitted over and secured to the cylindrical axles 17 are engaged with stationary gears 51 fixed to intermediate axles 73 which are slidably secured to the respective side boards 40 and 41 and with rotary gears 52 (having the same number of teeth as the gears 51) rotatably supported by the intermediate axles 73 through bearings 70. The rotary gears 52 are driven by a pulse motor 60 through a worm 56, a worm wheel 57, a shaft 55 to which the worm wheel 57 is fixed, and gears 54 which are fixed to the shaft 55.

The intermediate axle 73 on the left-hand side receives a thrust toward the inside of the side board 41 by virtue of a coil spring 53, which thrust bears upon a disc 71 which is in contact with the inner side of a connecting rod 61 that is rigidly connected to the intermediate axle 73 (the disc 71 is eccentrically fixed to an axle 72 supported by a bearing (not shown) which is mounted on the side board 41).

Accordingly, by rotating the axle 72 by means a DC motor (not shown) through a worm and a worm wheel (not shown), the intermediate axle 73 can be caused to slide. The other end of the connecting rod 61 is rigidly connected to a slide shaft 58. By virtue of the sliding of the intermediate axle 73, selection can be effected between the state in which the rotary gears 52 are exclusively engaged with the gears 20 while the gears 19 which are integral with the flanges 16 are engaged with the stationary gears 51 (Mode 1), and the state in which the stationary gears 51 are out of engagement with the gears 19 while the rotary gears 52 are engaged with both the gears 19 and 20 (Mode 2).

While the above description mainly relates to the mechanism shown on the left-hand side of FIG. 3, a similar mechanism is provided on the right-hand side. The mechanism on the right-hand side differs from that on the left-hand side in that the slide shaft 58 (extending from the left) and the intermediate axle 73 are not rigidly connected to each other through a connecting rod 62, but they are rotatably connected to each other by pins 64, with the connecting rod 62 rotatably connected through a pin 64 to a support member 63 fixed to the side board 40 acting as a lever. Accordingly, any sliding displacement of the left-hand side intermediate axle 73 effected by the rotation of the axle 72 causes the right-hand side intermediate axle 73 to make a reverse sliding displacement through the slide shaft 58 and the right-hand side connecting rod 62. This causes the selection between Modes 1 and 2 to be effected simultaneously on both the right and left sides.

Figure 4:
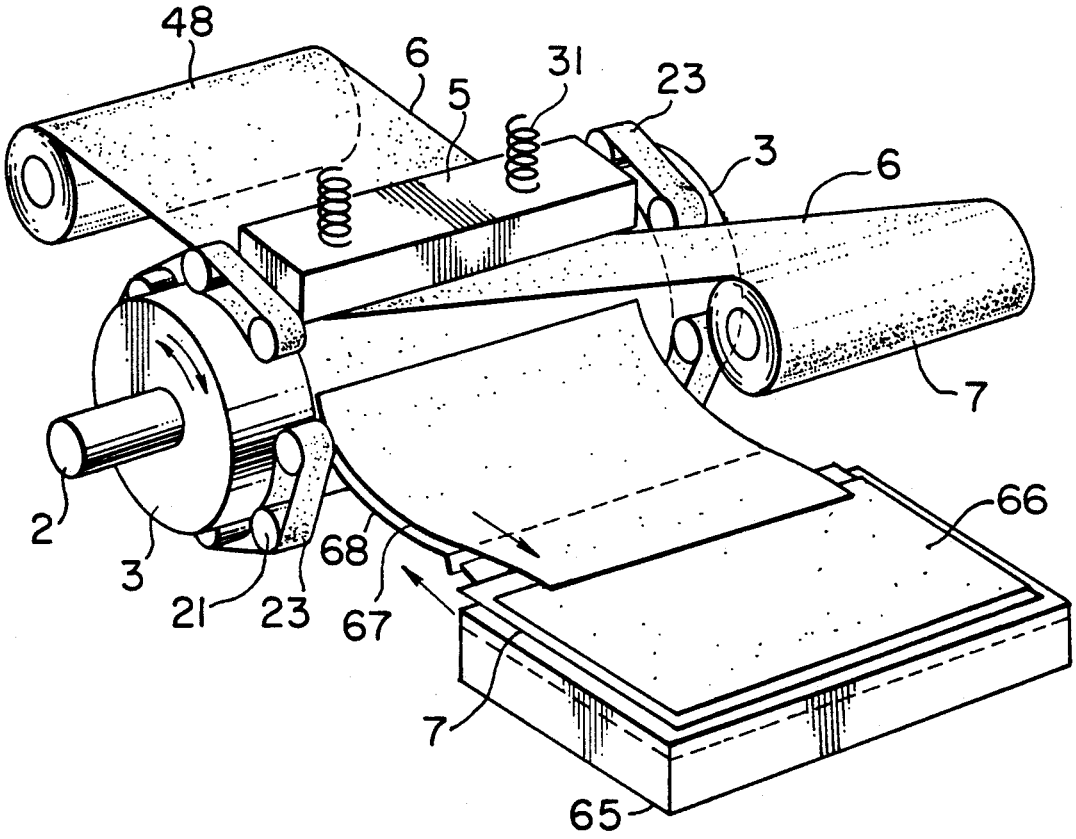
FIG. 4 is a perspective view of the first embodiment.

FIG. 4 illustrates the mechanism for supplying and discharging paper sheets which constitute the printing medium. The printing medium is extracted from a paper cassette 65 by, for example, a pick-up roller (not shown) and is fed along guide plates by a feeding roller (not shown). As shown in the drawing, the guide plates include a supply guide plate 68 and a discharge guide plate 67 which is superposed on the supply guide plate 68. A clearance is provided around the tip of the guide plates such that it does not come into contact with the surface of the printing medium wound around the drums 3.

In the above-described embodiment of the recording apparatus, the drums 3 are made of highly rigid material. The diameter of the platen roller 1 is smaller than that of the drums 3 (in this embodiment, smaller than one half of the drum diameter), and the surface of the platen roller is made of an elastic material such as rubber. The platen roller 1 is so arranged as to face the thermal printing head 4, the peripheral surface thereof at the facing position being at the same level as the peripheral surface of the drums 3, 3. The thermal printing head 4 extends over the length of the platen roller. Both edge sections of the printing medium passing between the thermal printing head 4 and the platen roller 1 are supported by the peripheral surfaces of the drums on both sides.

The diameters of the above-mentioned driven pulleys 10 and driving pulleys 11 are so determined that the platen roller 1 and the drums 3 rotate at the same peripheral speed and in the same direction.

In operation, first the slide position of the intermediate axles 73 is set to Mode 1, thereby fixing the flanges 16 in an unrotatable state by the stationary gears 51, and exclusively rotating the drums 3 and the platen roller 1 by the driving force of the motor 60 transmitted through the worm 56, the worm wheel 57, the shaft 55, the gears 54, the rotary gears 52, the gears 20, the cylindrical axles 14, the driving pulleys 11 and the driven pulleys 10. During this rotation, the axial positions of the free pulleys 21 supporting the elastic belts 23 remain the same, and the elastic belts 23 follow the drums 3 by virtue of frictional force to make a winding movement while guided by the free pulleys 21, their overall position as the loops remaining the same all the while. When the printing medium 7 is fed along the supply guide plate 68 to the section P where there is no elastic belt 23, while the thermal printing head 4 is kept in the retracted state, both edge sections of the printing medium 7 are caught between the elastic belts 23 and the drums 3, which causes the printing medium 7 to be automatically wound around the drums 3.

After winding the printing medium around the drums 3 over its entire length (this is detected by a photosensor separately provided or through pulse control of the pulse motor 60 for driving the drums), the slide position of the intermediate axles 73 is set to Mode 2, and the color of the ink film 6 is determined (e.g., yellow), with the thermal printing head 4 being lowered and pressed against the printing medium 7 on the platen roller 1. Since the slide position of the intermediate axles 73 at this time is selected to Mode 2 as stated above, the driving force of the motor 60 not only rotates the drums 3 and the platen roller 1 through the above-described transmission route, but also rotates the flanges 16 at the same rotational speed and in the same direction through the gears 54, the rotary gears 52, the gears 19 and the cylindrical axles 17, so that the elastic belts 23 and the drums 3 integrally rotate while holding the printing medium 7 between them without causing any relative movement between the belts 23 and the drums 3. (That is, the entire loops of the elastic belts 23 and the drums 3 integrally rotate around the stationary shaft 2.) During this rotation, electricity is supplied to the thermal recording head 4 in accordance with image data, thereby effecting printing on the printing medium 7.

After determining the color of the ink film 6 and conducting the above rotation three times to complete printing using three colors of yellow, magenta and cyan, the thermal printing head 4 is retracted and the slide position of the intermediate axles 73 is again set to Mode 1 so as to fix the flanges 16. The motor 60 is then reversely rotated to rotate the drums 3 and the platen roller 1 in the reverse direction, thereby discharging the printing medium 7 through the section P where there is no elastic belt 23 and along the discharge guide plate 67, setting it on a discharge tray 66.

This embodiment provides the following advantages, namely, since the printing medium is held between the peripheral surfaces of the drums and the elastic belts 23 over its entire length, positional deviation of the printing medium during printing can be avoided, allowing the printing medium to be fed with high accuracy and in a reliable manner. Moreover, since these retaining means using the elastic belts 23 are arranged on both outer sides of the printing head, they do not collide with the head, so that there is no need to retract the thermal recording head to avoid collision as in the prior art. In addition, since the drums which are in contact with the elastic belts for retaining the printing medium are made of a highly rigid material, the printing medium can be held in place with high accuracy.

Furthermore, since the diameter of the platen roller is smaller than that of the drums on both sides, the load which has to be applied to the thermal printing head so as to obtain the requisite surface pressure can be a smaller as compared with the case where the platen roller has the same diameter as the drums, thus giving the head a longer service life. If the drums have rough peripheral surfaces or their surfaces are covered with a material having a high friction coefficient (e.g., rubber), the printing medium can be retained even more effectively.

Printing on the printing medium 7 may also be started when the printing medium 7 passes the printing section for the first time as it is wound around the retaining sections between the drums 3 and the elastic belts 23. In that case, the thermal printing head 4 is kept pressed against the printing medium without being retracted. In the embodiment in which printing is conducted after the winding is completed, as stated above, the printing head 4 may be previously pressed against the printing medium during the winding process.

When performing printing using one color (e.g., black) only, one rotation will suffice for the printing. The operation of determining the ink color can then be omitted.

While in the above-described construction the platen roller 1 is driven by the pulleys 10, 11 and the belts 12 in such a manner that it rotates at the same peripheral speed as the drums 3, the platen roller 1 may also be driven by the frictional force between it and the printing medium wound around the drums 3, omitting the pulleys 10, 11 and the belts 12.

Figure 5:
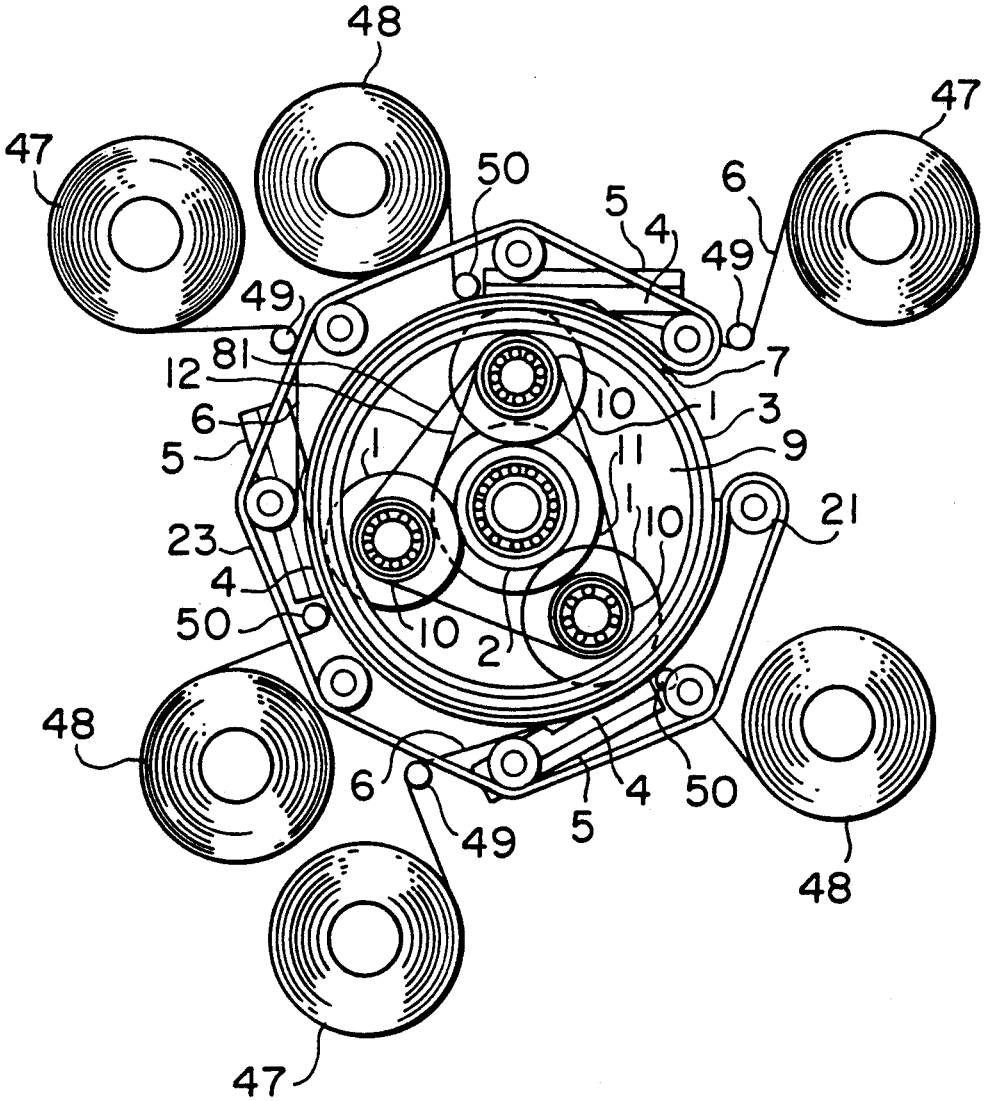
FIG. 5 is a cross-sectional view of a second embodiment of this invention.

FIG. 5 shows a second embodiment in which printing with a plurality of colors is effected in the course of one rotation using three thermal heads. The embodiment of FIG. 5 includes three platen rollers 1 which are rotatably supported at predetermined positions. A retractable thermal printing head 4 is provided for each of the platen rollers 1 in such a manner as to face it. Three sets of ink films 6 and supply and take-up rolls 47 and 48 are provided accordingly. One of the platen rollers 1 is driven by the belts 12 and the pulleys 11 fixed to the drums 3, thereby driving the other platen rollers 1, which causes all the platen rollers 1 to rotate at the same peripheral speed and in the same direction as the drums 3. Otherwise, the construction of this embodiment is the same as that of first embodiment.

As in first embodiment, the thermal printing heads 4 are retracted, with Mode 1 being selected to fix flanges 16 supporting pulleys 22 around which respective elastic belts 23 are wound to be guided. By rotating the drums 3 in this condition, printing media 7 are wound around the respective outer peripheries of the drums 3 and are retained thereon. Next, the ink films of the respective printing sections are set to the start position. Mode 2 is then selected, as in the first embodiment, to press the thermal printing heads 4 against the respective printing media, with the support systems including the drums 3, the platen rollers 1 and the elastic belts 23 being rotated in synchronization with each other. Electricity supply is timed to the thermal printing heads 4, thereby making it possible to effect multi-color printing with one rotation. Afterwards, Mode 1 is selected again, as in the first embodiment, to discharge the printing media.

Figure 6:
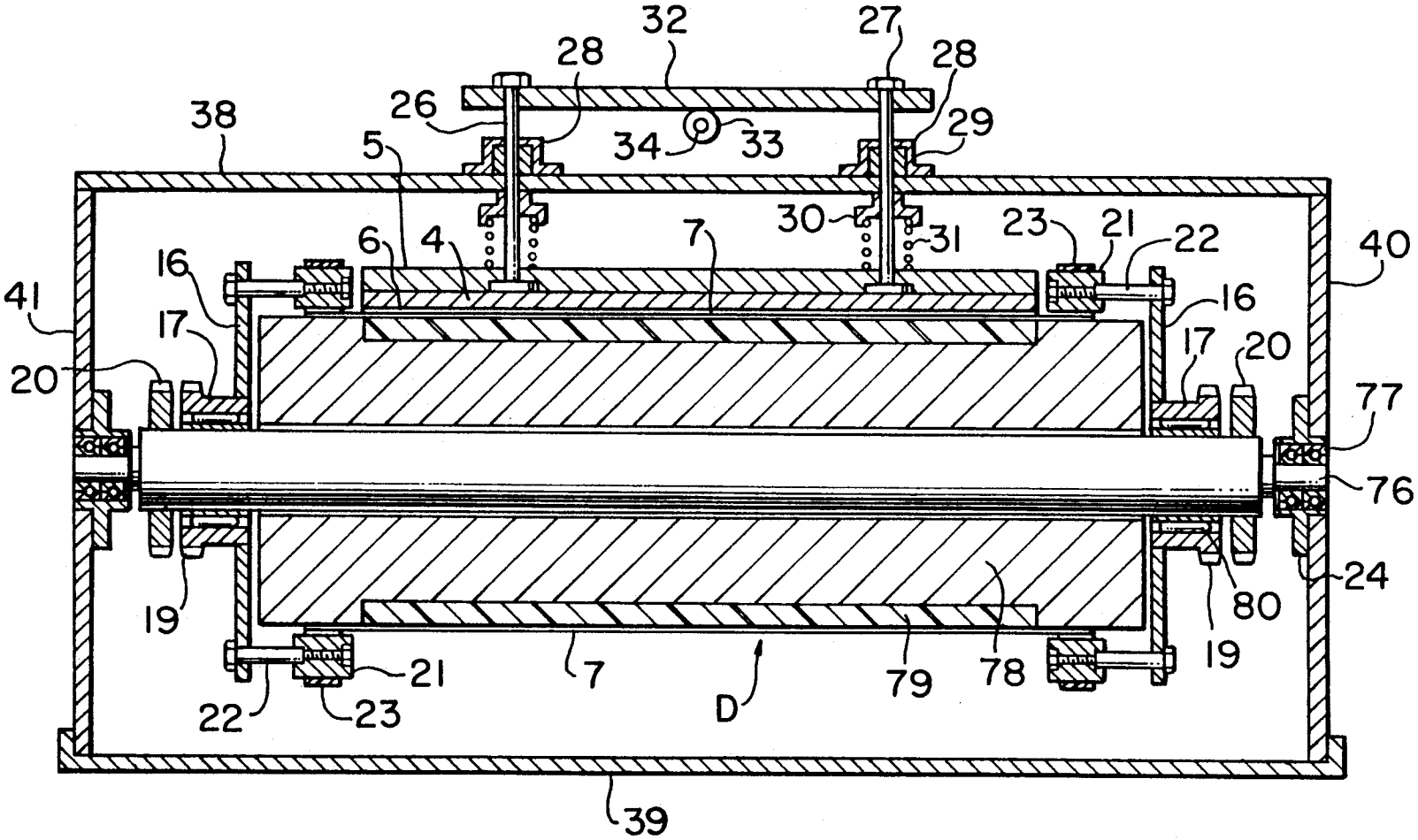
FIG. 6 is a longitudinal sectional view of a third embodiment of this invention.

FIG. 6 shows a third embodiment in which the platen roller is integrated with the drums which constitute the rotary support members. In the embodiment shown in FIG. 6, the platen drum D has drum sections 78' having high rigidity and adapted to retain a printing medium 7 which is wound around them. The platen drum D has, in a middle section thereof, a roller section 79 which is made of an elastic material such as rubber, with the drum sections 78' at the ends and a core section 78 inside the roller section 79 in the middle being formed integrally with each other to constitute an integral cylindrical body. This platen drum D is fixed to an axle 76 which is rotatably supported by bearings 77 provided in side boards 40 and 41. As in first embodiment, elastic belts 23 are wound around the respective outer peripheries of the drum sections 78' at the ends of the platen drum D and are wound around and guided by pulleys 21 arranged on flanges 16. These flanges 16 are fixed to respective cylindrical axles 17 which are concentrically and rotatably supported by axle 76 by means of respective bearings 80. Fixed to these cylindrical axles 17 and the rotary axle 76 are gears 19 and 20 having the same number of teeth. By driving these gears, the platen drum and the flanges 16 rotatably supporting the platen drum and the elastic belts 23 can be rotated, respectively. As in the first embodiment, a thermal printing head 4 is retractably supported at such a position as to face the elastic roller section 79 of the platen drum. Otherwise, the construction of this embodiment is the same as that of the first embodiment.

In the operation of the embodiment of FIG. 6, first, the thermal printing head is retracted, as in first embodiment, and Mode 1 is selected to fix the gears 19, driving the gears 20 only and thereby winding the printing medium 7 around the respective outer peripheries of the drums by the elastic belts 23 wound around the free pulleys 21 and retaining them thereon. Next, as in the first embodiment, Mode 2 is selected, thereby driving the gears 19 and 20 in synchronism with each other and setting the tip of the printing section of the printing medium 7 at the printing position. Next, the ink film 6 is set to yellow, and the retraction of the thermal printing head 4 is released to press it against the printing medium, thereby effecting printing. During printing, the platen drum is rotated in synchronism with the flanges 16 supporting the elastic belts 23, as in the first embodiment, to feed the printing medium 7 while retaining it on the platen drum, so that printing can be effected with high accuracy. Printing using the colors of magenta and cyan is performed in the same manner to effect three-color printing. Afterwards, the thermal printing head 4 is retracted, and Mode 1 is selected again to fix the gears 19 and reversely rotate the gears 20 only, thereby discharging the printing medium 7. That is, the flanges 16 supporting the elastic belt 23 are fixed and only the platen drum is rotated reversely, thereby discharging the printing medium 7.

Figure 7:
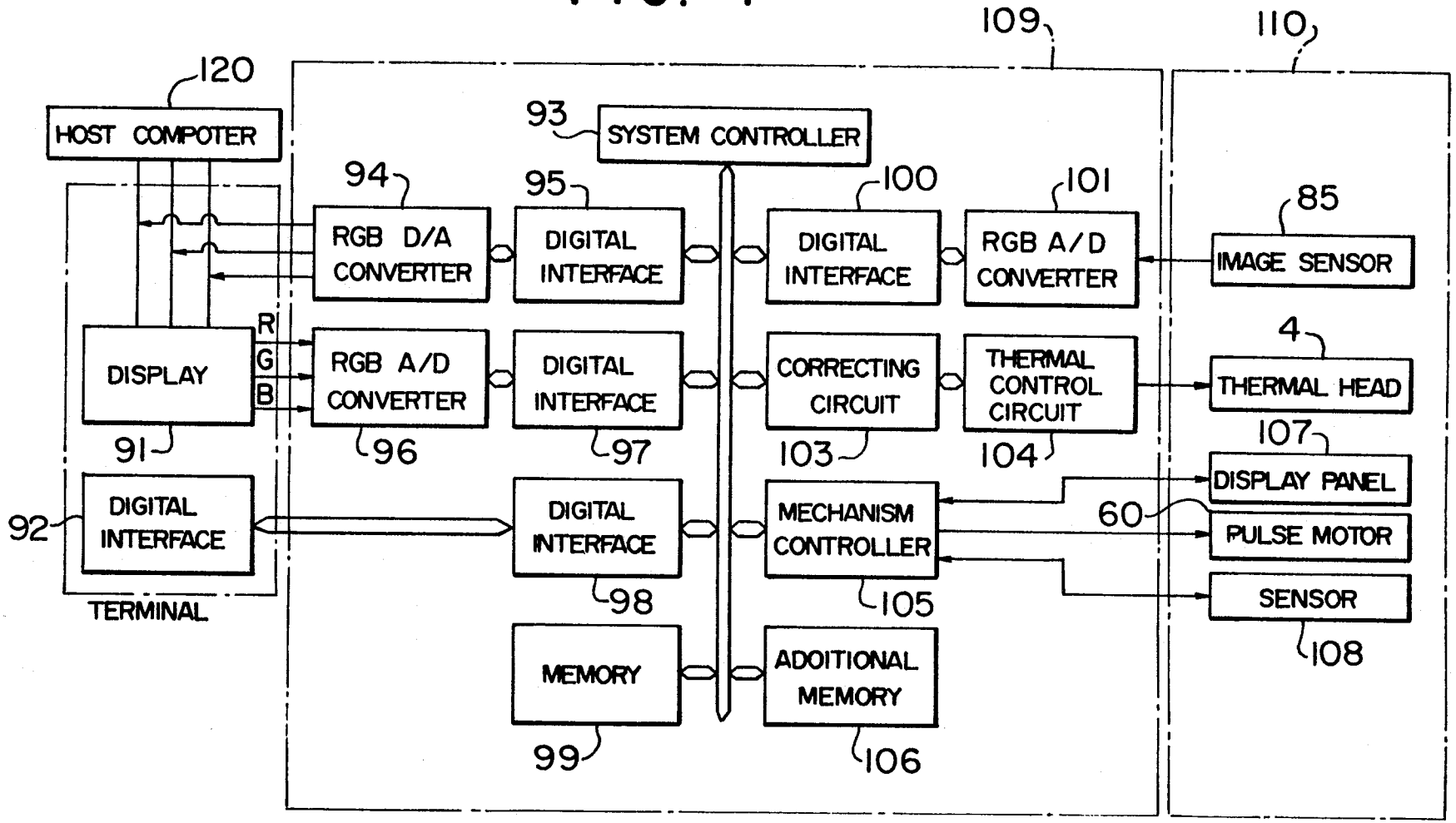
FIG. 7 is an overall block diagram showing a fourth embodiment to which this invention is applied.
Figure 8:
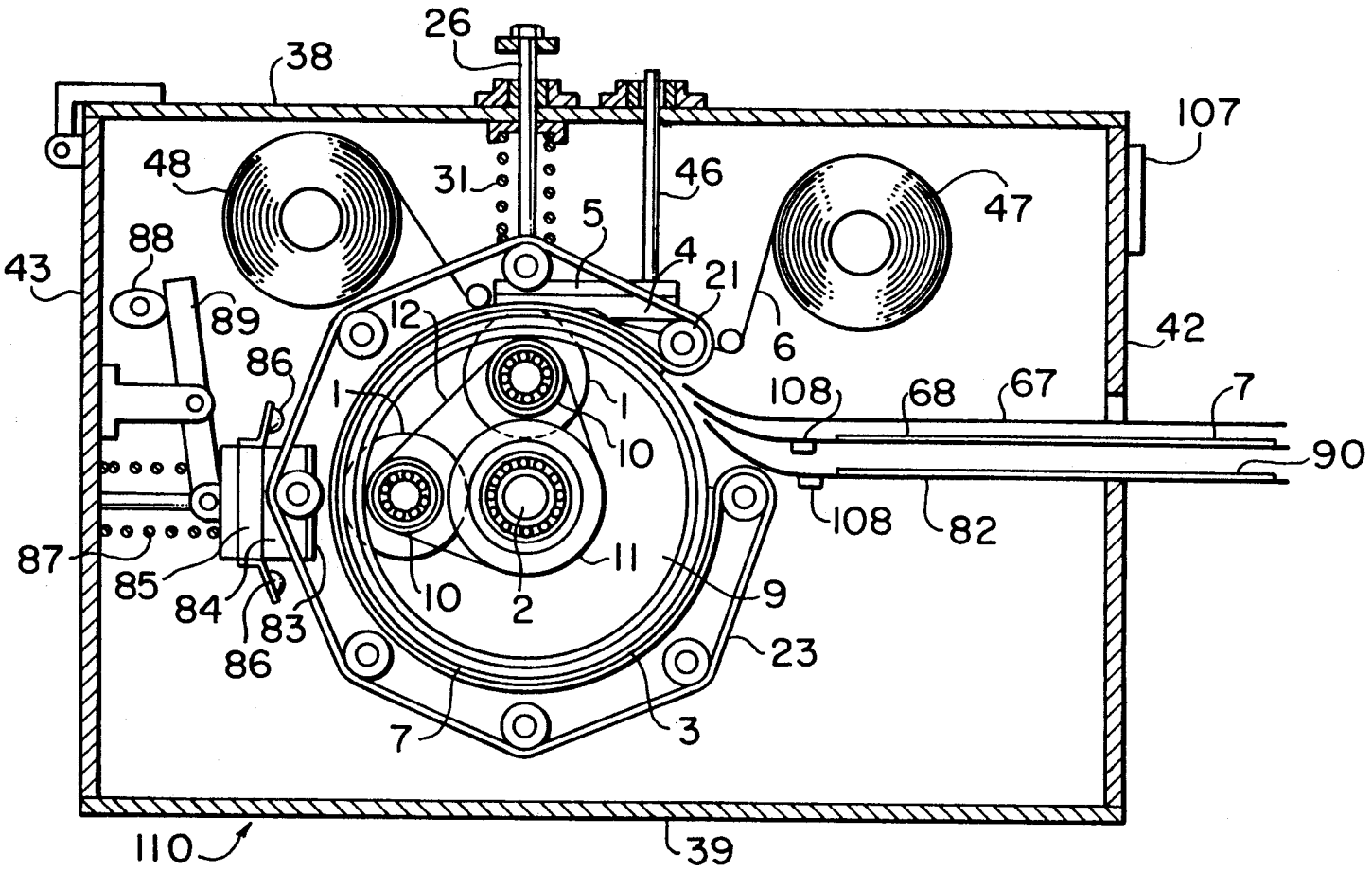
FIG. 8 is a cross-sectional view of the mechanism section of the fourth embodiment.

FIGS. 7 and 8 illustrates a fourth embodiment of a drum-type color printer which enables reading and printing.

As shown in FIG. 7, the drum-type printer which enables reading and printing comprises a control section 109 and a mechanism section 110. The control section 109 comprises an input section for reading an original 90 by means of an image sensor 85; a recording section for recording data obtained by means of a thermal head 4; a mechanism control section for operating a pulse motor 60, a display panel 107 and a sensor 108; an image signal output section for outputting an image signal input by means of the image sensor 85 to a display 91 on the host computer side; a first take-up section for taking up the image signal displayed on the display 91 and a second take-up section for receiving recording data from the host computer. The image data or original 90 is read by the image sensor 85, and the image data is inputted as an analog RGB signal. The signal is converted into a digital signal by an A/D converter 101, and is inputted through an interface 100 and stored in a memory 99. When the next printing is performed, the data stored in the memory 99 is corrected by a correcting circuit 103, and is then printed on a paper sheet (printing medium) 7 by the thermal head 4 to which the corrected data is sent through a thermal control circuit 104. If the capacity of the memory 99 is insufficient, an additional memory 106 is provided.

The image signal stored in the memory 99 may also be transmitted through an interface 95 and is converted into an analog signal by an RGB D/A converter 94. Afterwards, it can be displayed on the display 91 which is provided as the terminal of the host computer 120. There are two types of general printing methods. According to one of them, a analog RGB signal from the display 91 is taken up and converted into a digital signal by an A/D converter 96, and is then inputted through an interface 97. According to the other, image data is inputted through an interface 92 (e.g., centronics) and an interface 98. Next, the construction and operation of the mechanism section will be described with reference to FIG. 8. The construction of embodiment of FIGS. 7 and 8 is the same as that of the first embodiment except for the following points.

The scanner reading section for reading includes a scanner block comprising a glass plate 83, a rod lens array 84, an image sensor 85 and an LED array 86. The scanner block as a whole is supported by a rear board 43 through the intermediary of a lever 89 and is pressurized by a spring 87. In addition to the platen roller 1 which faces the thermal printing head 4, there is provided another platen roller 1 which faces the scanner block. These platen rollers 1 are rotated in the same direction as the drums 3 by driving pulleys 11 and belts 12. Through selection of the turning angle of an eccentric cam 88, the gap between the scanner block and the platen roller 1 which faces it is kept at a predetermined value. When reading an original, the scanner block is brought near that platen roller so as to make the gap suitable for the operation. When performing printing by the thermal printing head 4, the scanner block can be retracted so that it will not act as an obstacle.

When an original reading push-button switch (not shown) provided on a display panel 107 is depressed, Mode 2 is selected by way of the control effected by a mechanism controller 105. The thermal printing head 4 and the scanner block are then retracted by operating the driving motor for respectively retracting them. The stop of the thermal printing head 4 and the scanner block is effected by the signals generated according to the sensed position in a position sensor (not shown) respectively mounted thereon. Then, the drum 3 is rotated to the take-up position of the original 90 together with the flange 16 in accordance with the rotation of the pulse motor 60. The stop of the drum 3 and the flange 16 is effected by sensing the stop position of the flange 16 by the position sensor (not shown). In this time, after the operation Mode 1 is selected, an original 90 is supplied along the guide plate 82 by the feed rollers (not shown). The fixing of the original which is effected by winding it on the periphery of the drum 3 is made by operating the pulse motor 60 for driving the drum 3 in the direction of winding the original 90 between the drum 3 and the elastic belt 23 during a predetermined time from the point of time when the paper tip sensor 108 senses the tip of the original 90.

This predetermined time is set with respect to the revolution speed of the drum 3 so that the entire length of the original 90 is entered within the retaining portion of the elastic belt 23. Next, the operation Mode 2 is selected, whereby the drum 3 is rotated to the position just before the tip of the original 90 arrives at the scanner block. Then, the driving motor for retracting the scanner block is operated to set the scanner block at the reading position. In the operation Mode 2 as it is, the pulse motor 60 makes the drum 3, the platen roller 1 and the flange 16 rotate, thereby allowing the original to be rotated and read.

After the scanner block is retacted, the pulse motor 60 rotates the drum 3 together with the flange 16 and stops it at the discharge position of the original 90.

Furthermore, the feed and discharge of the original are effected by the drum 3 and the flange 16 at the same position, thereby allowing the stop position of the flange 16 to be sensed by the position sensor. Next, the operation Mode 1 is selected, wherein the pulse motor is reversely operated to discharge the original 90 on the discharge guide 67. Then, on the display panel 107, the display lamp (not shown) for displaying the reading finish of the original is lighted. After that, if necessary, the image data is compiled in the host computer, thereby allowing the printing to be effected.

In the printing, the printing bottom (not shown) on the display panel 107 is depressed to operate the mechanism controller 105, thereby selecting the operation Mode 2 to operate the driving motor for retracting the thermal printing head 4 and the scanner block and retract them. Further, the ink film 6 is wound so as to expose the heading portion of yellow by sensing the bar cord located on the tip of the yellow portion by the sensor (not shown). The pulse motor 60 rotates the drum 3, the flange 16 and the platen roller 1 and stops them at the feed position of the printing medium 7. Next, after the operation Mode 1 is selected, the printing medium 7 is supplied from the paper sheet feed casette (not shown). The drum 3 is rotated in the paper sheet supplying direction during the predetermined time from the point in time when the paper tip sensor 108 senses the tip of the printing medium 7, thereby allowing the printing medium 7 to be wound between the drum 3 and the elastic belt 23 and fixed therein. Next, the operation mode 2 is selected to feed the tip of the printing medium 7 to the position of the thermal printing head 4 according to the rotation of the drum 3 driven by the pulse motor 60. The driving motor for retracting the thermal printing head 4 is operated to press the thermal printing head 4 on the printing medium 7. Further, the pulse motor 60 rotates the drum 3, the platen roller 1 and the flange 16, and then the printing is effected on the printing medium 7 from the printing starting position thereof by conducting the electric current according to the image data to the thermal printing head 4. In this time, the ink film 6 is torn away in the tearing roller 50 and thereafter wound by the ink film roll 48 rotating with the predetermined torque. The printing is finished after the three ink colors of yellow, magenta and cyan are printed on the printing medium 7 by the three rotations of the drum 3 winding the printing medium 7 thereon and the flange 16. Furthermore, when the printing of yellow and magenta is finished, the thermal printing head 4 is retracted and the ink film 6 is freely fed. The bar cord of the tip of magenta or cyan is read by the sensor, thereby allowing winding of the ink film to be stopped. When the tip of the printing medium 7 arrives at the position of the thermal printing head according to the rotation of the drum 3, the thermal printing head 4 is pressed on the printing medium 7 and the winding of the ink film 6 is started.

To finish the printing, the thermal printing head 4 is retracted and the pulse motor 60 reversely rotates the drum 3 together with the flange 16 to the discharge position of the printing medium 7. The pulse motor 60 is stopped by sensing the stop position of the flange 16 by the position sensor. Next, the operation Mode 1 is selected to cause the pulse motor to rotate in the discharge direction of the printing medium 7, thereby discharging the printing medium 7 on the discharging guide 67 and finishing the printing.

The construction shown in FIG. 6 allows for a plurality of printing heads to be arranged at different angular positions around the platen roller 79 in the same manner as in the second embodiment, or an embodiment in which one of those printing heads is replaced by a reading scanner in the same manner as in the fourth embodiment.

Thus, in accordance with this invention, a printing medium is wound around and retained on the outer peripheries of drums over its entire length, so that the printing medium can be fed reliably and with high accuracy without involving any positional deviation. Furthermore, since the means for retaining the printing medium are arranged on both outer sides of the thermal printing head, collision of the drums with the printing head during rotation of the drums can be avoided, so that there is no need for retracting the head for the purpose of avoiding collision, as in the prior art. In addition, in the case where the platen roller is prepared as a separate member with respect to the drums on both sides thereof as in the first, second and fourth embodiments and a diameter of the roller is smaller than a diameter of the drums, the load applied to the thermal printing head for the purpose of obtaining the requisite surface pressure can be relatively small, and the printing head can thus be expected to enjoy a longer service life.

What is claimed is:

1. A printing apparatus comprising a printing head, a printing support rotatably mounted on the printing apparatus, supporting means rotatably provided on said printing support, retaining means for retaining a printing medium on said supporting means continuously and in such a manner that it is movable with respect to said supporting means, and means for either rotating said supporting means relative to said retaining means when the printing medium is supplied or making said supporting means stationary relative to said retaining means when a printing is performed on the printing medium.

2. A printing apparatus as claimed in claim 1, further comprising means for driving said printing support in the same direction and at the same peripheral speed as said supporting means.

3. A printing apparatus as claimed in claim 1, wherein a plurality of said printing supports are provided and a plurality of thermal heads are arranged so as to respectively face the printing supports.

4. A printing apparatus as claimed in claim 3, further comprising means for driving said printing supports in the same direction and at the same peripheral speed as said supporting means.

5. A recording apparatus as claimed in claim 1, wherein said retaining means comprises a plurality of pulleys arranged in such a manner so as to revolve around respective rotational axes of said supporting means, elastic belt loops are provided having outer surfaces in contact with peripheral surfaces of said supporting means except for sections between the ends of the respective loops, and a driving means is provided for causing said plurality of pulleys to revolve at the same angular velocity as the supporting means.

6. A printing apparatus according to claim 1, wherein the printing apparatus is a thermal-transfer printing apparatus for effecting a thermal transfer printing by a thermal printing head on a printing medium using an ink film, said printing support includes a rotatably supported platen roller having a surface of an elastic material, said thermal printing head faces said platen roller and is arranged within a longitudinal range in an axial direction thereof, said supporting means includes a pair of drums having a high rigidity and the same diameter as a diameter of said platen roller, said pair of drums are arranged on respective sides in the axial direction of said platen roller and are rigidly connected to said platen roller to form an integral cylindrical member with said platen roller, said drums being positioned such that both sides sections of the printing medium reach respective peripheral surfaces thereof and have a circumference sufficient to allow an entire length in a feed direction of the printing medium to be wound around the drums, and means are provided for driving said drums, wherein said retaining means are arranged around respective outer peripheries of said drums and are adapted to continuously retain both side sections of the printing medium in such a manner that the retaining means are movable with respect to said outer peripheries of said drums, and wherein said side sections of the printing medium are in contact with respective outer peripheries of said drums and held between said retaining means and said outer peripheries.

7. A thermal-transfer printing apparatus as claimed in claim 6, wherein a plurality of thermal printing heads are arranged at different positions around said platen roller.

8. A thermal-transfer printing apparatus as claimed in claim 6, wherein said printing medium retaining means comprise a plurality of pulleys arranged in such a manner so as to revolve around the respective rotational axes of said drums, elastic belt loops are provided having outer surfaces in contact with peripheral surfaces of said drums except for sections between ends of the respective loops, and a driving means is provided for causing said plurality of pulleys to revolve at the same angular rotational velocity as the drums.

9. A thermal-transfer printing apparatus according to claim 1, wherein the printing apparatus is a thermal-transfer printer for effecting a thermal-transfer printing by a plurality of thermal printing heads on a printing medium using an ink film, said printing support includes a rotatably supported platen roller having a surface of an elastic material, said plurality of thermal printing heads face said platen roller and are arranged within a longitudinal range in an axial direction thereof and at different angular positions around said platen roller, at least one image reader is disposed in place of at least one of said plurality of said thermal printing heads, said supporting means includes a pair of drums having a high rigidity and of the same diameter as a diameter of said platen roller, said drums are arranged on respective sides in the axial direction of said platen roller and are rigidly connected to said platen roller to form an integral cylinder member with said platen roller, said drums are positioned such that both side sections of the printing medium reach respective peripheral surfaces thereof and have a circumference sufficient to allow an entire length in a feed direction of the printing medium to be wound around the drums, means are provided for driving said drums, and wherein said retaining means are arranged around respective outer peripheries of said drums and are adapted to continuously retain both side sections of the printing medium in such a manner that the retaining means are movable with respect to said outer peripheries, said side sections of the printing medium being in contact with the respective outer peripheries of said drums and held between said retaining means and said outer peripheries.

10. A thermal-transfer printing apparatus as claimed in claim 9, wherein said retaining means comprise a plurality of pulleys arranged in such a manner so as to revolve around respective rotational axes of said rotary support members, elastic belt loops are provided having outer surfaces in contact with outer peripheries of said drums except for sections between the ends of the respective loops, and driving means are provided for causing said plurality of pulleys to revolve at the same angular velocity as the drums.

11. A printing apparatus as claimed in one of claims 1, 2, or 5, wherein said printing head is applied as a thermal-transfer printing head and allows an inked film and a printing medium to pass between the thermal-transfer printing head and the printing support so that the printing head can effect thermal-transfer printing.

12. A thermal-transfer printing apparatus of the type which effects thermal-transfer printing on a printing medium using an ink film, the thermal-transfer printing apparatus comprising: a rotatably supported platen roller having a surface of an elastic material; a thermal printing head facing said platen roller and arranged within a longitudinal range in the axial direction thereof; a pair of drums having a high rigidity arranged in parallel on both sides in the axial direction of said platen roller and provided as separate independent members with respect to said platen roller, said drums being positioned such that both side sections of the printing medium reach respective peripheral surfaces thereof and having a circumference sufficient to allow an entire length in the feed direction of the printing medium to be wound around the drums, said platen roller having a diameter smaller than a diameter of said drums and a platen roller surface not protruding beyond said drums and at the same level with the peripheral surfaces of the drums at the position where the platen roller faces said thermal printing head; a means for driving said drums; and printing medium retaining means arranged around the respective outer peripheries of said drums and adapted to continuously retain both side sections of the printing medium in such a manner that the retaining means are movable with respect to said peripheral surfaces, said side sections of the printing medium being in contact with the respective outer peripheries of said drums and being held between said printing medium retaining means and said outer peripheries of said drums.

13. A thermal-transfer printing apparatus as claimed in claim 12, further comprising means for driving said platen roller in the same direction and at the same peripheral speed as the drums.

14. A thermal-transfer printing apparatus as claimed in claim 12, wherein a plurality of said platen rollers and a plurality of thermal heads respectively facing said platen rollers are provided.

15. A thermal-transfer printing apparatus as claimed in claim 14, further comprising means for driving said platen rollers in the same direction and at the same peripheral speed as the drums.

16. A thermal-transfer printing apparatus as claimed in claim 12, wherein said printing medium retaining mans comprise a plurality of pulleys arranged in such a manner so as to revolve around respective rotational axes of said drums, elastic belt loops are provided having outer surfaces in contact with peripheral surfaces of said drums except for sections between the ends of the respective loops, and driving means are provided for causing said plurality of pulleys to revolve at the same angular velocity as the drums.

17. A thermal-transfer printing apparatus according to claim 12, wherein a plurality of rotatably supported platen rollers are provided each having a surface of an elastic material, said thermal printing head faces said plurality of platen rollers, an image reader is arranged in such a manner so as to face at least one of said platen rollers, and wherein each of said platen rollers has a diameter smaller than a diameter of said drums and platen roller surfaces not protruding beyond said drums and at the same level with peripheral surfaces of the drums at a position where the platen rollers face said thermal printing head.

18. A thermal-transfer printing apparatus as claimed in claim 17, wherein said printing medium retaining means comprise a plurality of pulleys arranged in such a manner so as to revolve around respective rotational axes of said drums, elastic belt loops are provided having outer surfaces in contact with peripheral surfaces of said drums except for sections between the ends of the respective loops, and driving means is provided for causing said plurality of pulleys to revolve at the same angular rotational velocity as the drums.

19. A thermal-transfer printing apparatus as claimed in claim 17, further comprising means for driving said plurality of platen rollers in the same direction and at the same peripheral speed as the drums.

20. A printing apparatus for effecting printing on a printing medium, the printing apparatus comprising a rotatably supported platen roller having the surface of an elastic material, a printing head facing said platen roller and arranged so as to extend at an axial direction thereof; a pair of high rigidity drums arranged in parallel on both sides in the axial direction of said platen roller and forming separate independent members with respect to said platen roller, said drums being positioned such that both side sections of the printing medium reach the respective peripheral surfaces thereof and have a circumference sufficient to allow an entire length in the feed direction of the printing medium to be wound around the drums, said platen roller having a diameter smaller than a diameter of said drums and a platen roller surface not protruding beyond said drums and at the same level with the peripheral surface of the drums at a position where the platen roller faces said printing head; means for driving said drums; and printing medium retaining means arranged around respective outer peripheries of said drum and adapted to continuously retain both side sections of the printing medium in such a manner that the retaining means are movable with respect to said peripheral surfaces, said side sections of the printing medium being in contact with the respective outer peripheries of said drums and held between said printing medium retaining means and said outer peripheries of said drums.

21. A printing apparatus according to claim 20, further comprising means for driving said platen roller in the same direction and at the same peripheral speed as the drums.

22. A printing apparatus according to claim 20, wherein a plurality of platen rollers and a plurality of printing heads respectively facing said platen rollers are provided.

23. A printing apparatus according to claim 22, further comprising means for driving said platen rollers in the same direction and at the same peripheral speed as the drums.

24. A printing apparatus according to claim 20, wherein said printing medium retaining means comprises a plurality of pulleys arranged so as to revolve around respective rotational axes of said drums, elastic belt loops having outer surfaces in contact with peripheral surfaces of said drums except for sections between the ends of the respective loops, and driving means for causing said plurality of pulleys to revolve at the same angular velocity as the drums.

* * * * *